US009622534B2

(12) United States Patent
Cormier et al.

(10) Patent No.: US 9,622,534 B2
(45) Date of Patent: Apr. 18, 2017

(54) REBOUNDING CUSHIONING HELMET LINER

(71) Applicant: VICONIC DEFENSE INC., Dearborn, MI (US)

(72) Inventors: Joel M. Cormier, East Lathrup Village, MI (US); Donald S. Smith, Commerce Township, MI (US); Richard F. Audi, Dearborn, MI (US)

(73) Assignee: Viconic Sporting LLC, Dearborn, MI (US)

( * ) Notice: Subject to any disclaimer, the term of this patent is extended or adjusted under 35 U.S.C. 154(b) by 0 days.

(21) Appl. No.: 15/242,730

(22) Filed: Aug. 22, 2016

(65) Prior Publication Data

US 2016/0353826 A1 Dec. 8, 2016

Related U.S. Application Data

(60) Division of application No. 13/487,462, filed on Jun. 4, 2012, now Pat. No. 9,420,843, which is a (Continued)

(51) Int. Cl.
*A42B 3/00* (2006.01)
*A42B 3/12* (2006.01)
(Continued)

(52) U.S. Cl.
CPC ..... *A42B 3/124* (2013.01); *A41D 13/0156* (2013.01); *A42B 3/127* (2013.01); *A42C 2/002* (2013.01)

(58) Field of Classification Search
CPC ..... A42B 3/124; A42B 3/127; A41D 13/0156
See application file for complete search history.

(56) References Cited

U.S. PATENT DOCUMENTS 1,784,511 A 12/1930 Carns
2,090,881 A 8/1937 Wilson
(Continued)

FOREIGN PATENT DOCUMENTS

EP 0434834 A1 7/1991
EP 0630592 A1 12/1994
EP 1555109 A1 7/2005

OTHER PUBLICATIONS

International Search Report and Written Opinion; International application No. PCT/US2012/070006; date of mailing Feb. 15, 2013.

(Continued)

*Primary Examiner* — Richale Quinn
(74) *Attorney, Agent, or Firm* — Brooks Kushman P.C.

(57) ABSTRACT

An energy absorbing liner system and method of making it, preferably by thermoforming. A helmet has an energy absorbing inner system positioned inside the shell. The liner has thermoformed interconnected energy absorbing modules that non-destructively rebound after one or more impacts. At least some of the modules in the layer have a basal portion with upper and lower sections when viewed in relation to the wearer's head. The upper section has one or more energy absorbing units. At least some of the units are provided with a wall with a domed cap that faces the outer shell. The units at least partially cushion the blow by absorbing energy imparted by an object that impacts the outer shell. The lower comfort section has a tiered arrangement of layers. The layers are relatively compliant and thus provide a comfortable yet firm fit of the helmet upon the wearer.

9 Claims, 13 Drawing Sheets

Related U.S. Application Data continuation-in-part of application No. 13/328,489, filed on Dec. 16, 2011.

(51) Int. Cl.
*A41D 13/015* (2006.01)
*A42C 2/00* (2006.01)

(56) References Cited

U.S. PATENT DOCUMENTS 2,391,997 A * 1/1946 Noble ..... E04C 2/326 244/119
3,011,602 A 12/1961 Ensrud
3,018,015 A 1/1962 Agriss et al.
3,071,216 A * 1/1963 Jones ..... E04C 2/34 105/422
3,196,763 A 7/1965 Rushton
3,231,454 A * 1/1966 Williams ..... B65D 81/03 206/521
3,525,663 A * 8/1970 Hale ..... B29C 51/006 405/36
3,605,145 A 9/1971 Graebe
3,938,963 A 2/1976 Hale
4,023,213 A * 5/1977 Rovani ..... A42B 3/121 2/413
4,029,822 A * 6/1977 Comer ..... B65D 77/003 206/497
5,030,501 A * 7/1991 Colvin ..... B32B 3/12 206/522
5,390,467 A 2/1995 Shuert
5,391,251 A 2/1995 Shuert
5,401,347 A 3/1995 Shuert
5,444,959 A 8/1995 Tesch
5,470,641 A 11/1995 Shuert
5,549,327 A * 8/1996 Rusche ..... B60R 21/04 280/751
5,572,804 A 11/1996 Skaja et al.
5,635,275 A * 6/1997 Biagioli ..... B29D 99/0089 156/292
6,098,313 A 8/2000 Skaja
6,199,942 B1 3/2001 Carroll, III et al.
6,247,745 B1 6/2001 Carroll, III et al.
6,453,476 B1 9/2002 Moore, III
6,679,967 B1 1/2004 Carroll, III et al.
6,682,128 B2 1/2004 Carroll, III et al.
6,752,450 B2 6/2004 Carroll, III et al.
6,777,062 B2 8/2004 Skaja
7,328,462 B1 2/2008 Straus
7,360,822 B2 4/2008 Carroll, III et al.
7,377,577 B2 5/2008 Carroll, III et al.
7,404,593 B2 7/2008 Cormier et al.
7,625,023 B2 12/2009 Audi et al.
7,676,854 B2 * 3/2010 Berger ..... A42B 3/124 2/410
7,766,386 B2 8/2010 Spingler
7,802,320 B2 * 9/2010 Morgan ..... A42B 3/124 2/411
7,895,681 B2 * 3/2011 Ferrara ..... B29C 45/0053 2/455
7,908,678 B2 * 3/2011 Brine, III ..... A42B 3/12 2/410
7,954,177 B2 * 6/2011 Ide ..... A42B 3/08 2/425
7,958,573 B2 6/2011 Lewis, Jr. et al.
8,402,568 B2 * 3/2013 Alstin ..... A41D 13/018 2/413
8,510,863 B2 * 8/2013 Ferguson ..... A41D 31/005 2/69
8,528,118 B2 9/2013 Ide et al.
8,528,119 B2 9/2013 Ferrara
8,548,768 B2 10/2013 Greenwald et al.
8,566,988 B2 10/2013 Son et al.
2002/0017805 A1 2/2002 Carroll, III et al.
2008/0120764 A1 5/2008 Sajic
2010/0244469 A1 9/2010 Gerwolls et al.
2010/0299812 A1 12/2010 Maddux et al.

OTHER PUBLICATIONS

International Preliminary Report on Patentability; International application No. PCT/US2012/070006; date of issuance of report Jun. 17, 2014.

Brachmann, Steve, "Consussion Science, Stagnant Helmet Innovation and the NFL"; IPWatchdog.com; Feb. 2, 2014.

* cited by examiner

REBOUNDING CUSHIONING HELMET LINER

CROSS REFERENCE TO RELATED APPLICATION

This application is a divisional of U.S. Ser. No. 13/487,462 filed Jun. 4, 2012 (to issue as U.S. Pat. No. 9,420,843), which is a continuation-in-part of U.S. Ser. No. 13/328,489 that was filed on Dec. 16, 2011. Those patent applications are and is incorporated herein by reference.

BACKGROUND OF THE INVENTION (1) Field of the Invention

One aspect of the invention relates to an impact-absorbing helmet with a compliant liner system that absorbs energy generated by an impacting force exerted on the outside of the helmet and reverts toward an un-deflected, non-destroyed configuration after impact.

(2) Description of Related Art

Helmets and hard hats have been used for centuries in all types of activity where there is a risk of blunt force trauma to the head. These helmets will typically consist of three layers. The outer shell layer functions to protect the head from lacerations and abrasions from the incident object impacting the helmet. A comfort layer, which contacts the skull of the wearer, typically provides some level of padding to improve comfort and fit of the assembly to the skull. Interposed between the shell and the comfort layer, an energy absorbing system is often utilized to mitigate some of the impacting forces from the blunt force trauma. Often, for example in professional cycling, the helmet will need to be replaced after a blow is sustained In recent years, Mild Traumatic Brain Injury (MTBI) and concussions have gained more attention since the occurrence of these events do not seem to be decreasing markedly as the helmet technology has improved. Athletes, soldiers, and workers involved in one or more impact events often have short term or permanent loss of brain function as a result of these impact events. NOCSAE, FMVSS, and other helmet system performance standards have sought to improve the performance of helmet systems to reduce the severity of an impact event. However, consumers desire a helmet that not only protects them from the adverse effects of repeated hits, but one that is also aesthetically pleasing, non-restrictive, light weight, comfortable, breathable, safe, durable, and affordable. A helmet may provide exceptional impact protection but if it looks, smells, or feels uncomfortable then no one will wear it.

Helmet manufacturers such as Riddell, Schutt, CCM, Brine, Skydex, Gentex and the like provide helmet systems for various occupations and recreational sports. The outer shell of the helmet is designed in such a way that it protects the wearer from cuts and abrasions from the incident object. These shells are typically thermoplastic or thermoset composites that are extremely tough and rigid. During an impact event, the shell itself does absorb some of the impact energy by flexing in response to the impacting object. However, the majority of the impacting force is transferred from the shell into the shell cavity where the energy absorbing and comfort layers reside and ultimately are transferred to the wearer. This force transfer without significant absorption often presents a risk of injury.

Traditionally, the energy absorbing layer in the shell has been some type of foam assembly. The assembly may be comprised of one or more layers or grades of foam to provide both comfort and impact protection. The inner layer is typically lower in density and provides less energy absorbing contribution than the more rigid outer layer. Furthermore, some systems, such as Riddell's Revolution football helmet, also employ a bladder system that allows the wearer to customize the fit of the helmet to the skull based on the level of liner inflation. While these systems may be comfortable to wear, foam lacks energy absorbing efficiency. Furthermore, foam does not breathe well and its solid construction allows minimal room for airflow to cool the head.

More recently, helmet manufactures have been developing helmet liner systems constructed with a tougher energy absorbing layer made from thermoplastic resins. These materials are typically injection molded or twin sheet thermoformed as an energy absorbing layer. A separate system is utilized to provide comfort to the wearer. The energy absorbing structures, by design, are rigid and uncomfortable. One or more layers of comfort foam or padding is typically added to the assembly. This increases the cost of these systems. Furthermore, the manufacturing methods employed to produce the energy absorbing layer do not allow for a high degree of design flexibility to optimize performance.

Among the prior art considered in preparing this patent application is:

| Assignee Name | USPN/App # | Technology |
|---|---|---|
| Riddell | 7,954,177 | Foam |
| Brine | 7,908,678 | Foam |
| Xenith | 7,895,681 | TPU |
| Team Wendy | 6,453,476 | Foam |
| Gentex | 7,958,573 | Foam |
| Morgan | 7,802,320 | Foam |
| Crescendo | 7,676,854 | Plastic |
| Skydex | 6,777,062 | TPU |

Additionally, several of Applicant's patents (see, e.g., U.S. Pat. Nos. 6,199,942; 6,247,745; 6,679,967; 6,682,128; 6,752,450; 7,360,822; 7,377,577; 7,404,593; 7,625,023 which are incorporated herein by reference) describe an efficient modular tunable energy absorbing assembly for reducing the severity of an impact event.

BRIEF SUMMARY OF THE INVENTION

In one embodiment of the invention, there is a helmet with an outer shell and an energy absorbing layer positioned inside the shell. The layer has a cluster of thermoformed interconnected energy absorbing modules. At least some of the modules in the layer have a basal portion with upper and lower sections when viewed in relation to the wearer's head. Thus, the upper section is closest to an inner surface of the outer shell of the helmet. The lower section is closest to the wearer's head.

Preferably the upper section has one or more energy absorbing units. At least some of the units are provided with a substantially frustoconical wall with a domed cap. In some embodiments the wall, the domed cap or both cooperate to recoil non-destructively towards an un-deflected state after impact. The units at least partially cushion the blow by absorbing energy imparted by an object that impacts the outer shell before reversion. If desired, one or more ribs interconnect at least some of the energy absorbing units in one or more modules.

In some embodiments, the lower section has a tiered arrangement of layers. An outermost layer cooperates with and lies inside a periphery of a module in the upper section. One or more intermediate layers extend from and within the outermost layer. An innermost layer extends from and within an intermediate layer. The layers are relatively compliant and thus provide a comfortable yet firm fit of the helmet upon the wearer. In some embodiments the tiered arrangement of layers cooperates with the upper section by contributing to rebounding of the energy absorbing layer after impact.

At least some of the innermost layers are provided with an aperture that reduces weight and allows air within the clusters to bleed therefrom.

DETAILED DESCRIPTION OF THE PREFERRED EMBODIMENTS

Figure 1:
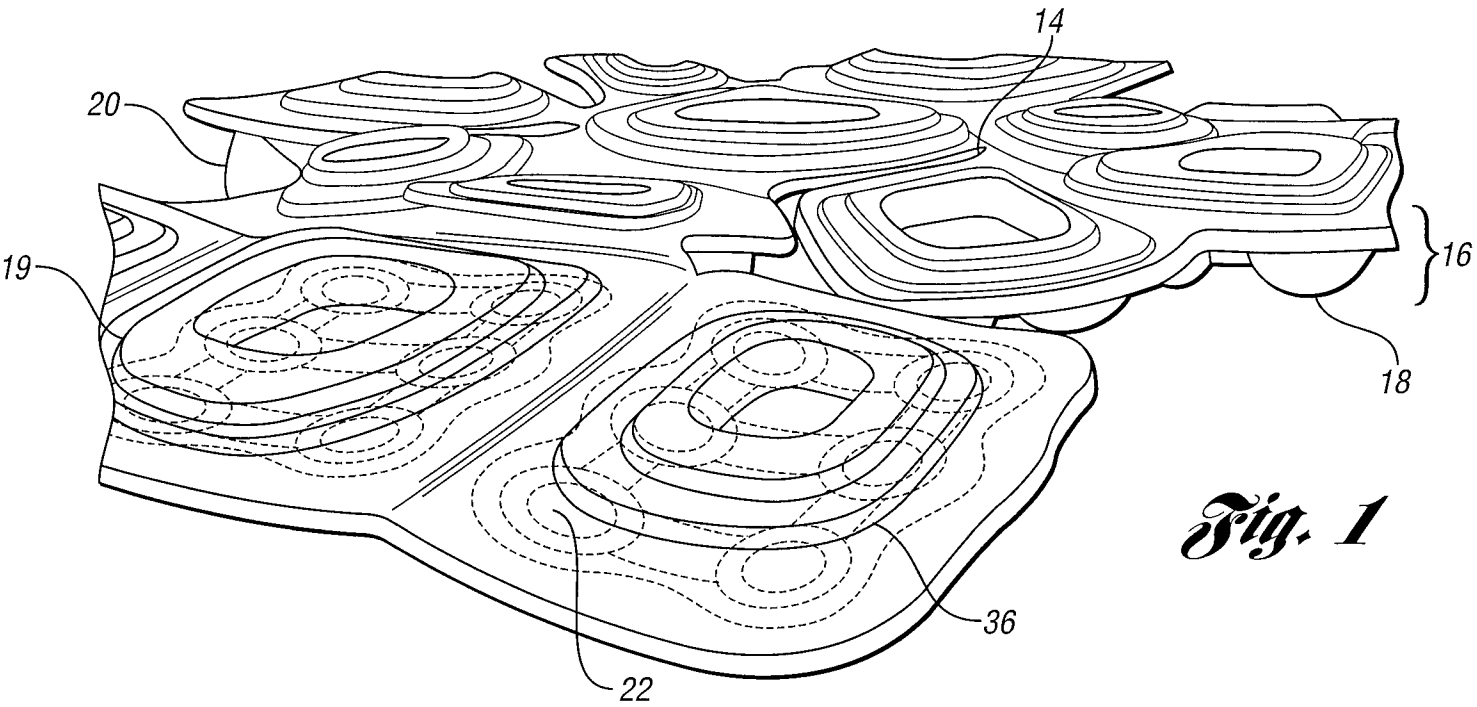
FIG. 1 is a perspective view of one illustrative embodiment of an energy absorbing liner system that at least partially reverts to or towards an un-deflected configuration non-destructively after one or more impacts.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

In one embodiment of the invention (FIGS. 12-14), there is an incident surface such as a helmet 10 with a resilient outer shell 12 that meets an impacting or impacted object with virtually no change in its shape after impact. Besides a helmet, other incident surfaces include for example, an automotive headliner, a knee bolster, a bumper and a steering wheel, plus various personal protectors, such as an elbow guard, a shoulder pad, an abdominal protector, a knee pad, and a wrist pad. An energy absorbing (EA) layer or liner system 14 is positioned inside the shell 12. The layer 14 has an assembly of thermoformed energy absorbing modules 16 that either together (like a jigsaw puzzle) or are structurally interconnected. The modules 16 cooperate to afford an energy absorbing structure that rebounds following the hit to or toward a pre-impact configuration in such a way that the modules 16 are not destroyed by one or repeated blows.

At least some of the modules 16 in the layer 14 have upper and lower basal portions 18, 19 with upper 20 and lower 22 sections when viewed in relation to the wearer's head 24. Thus, the upper section 20 is closest to the outer shell 12 of the helmet 10 while the lower section 22 is closest to the wearer's head 24. Thus, the upper section 20 is positioned toward the inner surface 26 of the outer shell 12 and the lower section 22 lies closer to the head 24 of a wearer.

Figure 12:
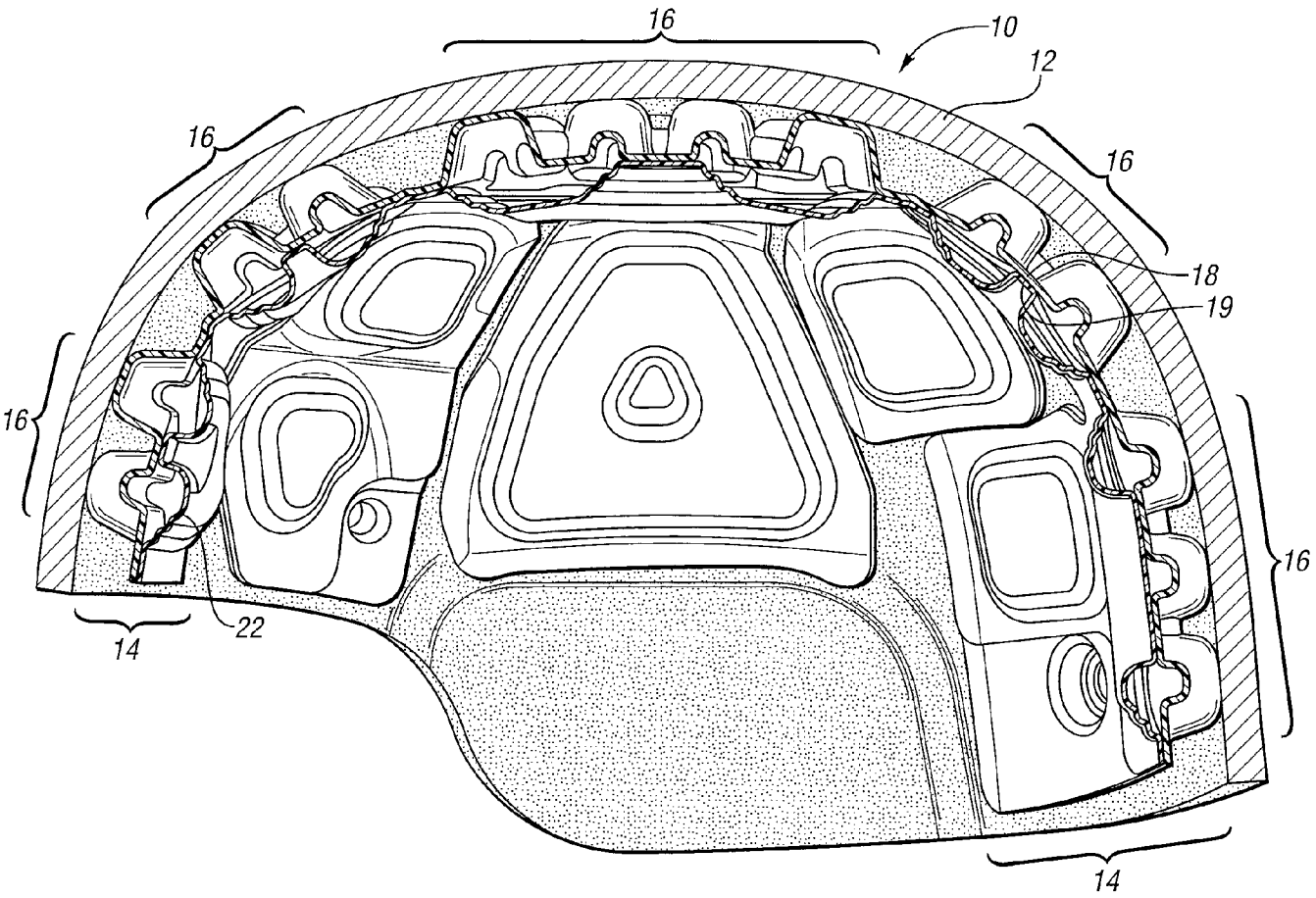
FIG. 12 is a vertical longitudinal cross-sectional view of a helmet-liner assembly.
Figure 13:
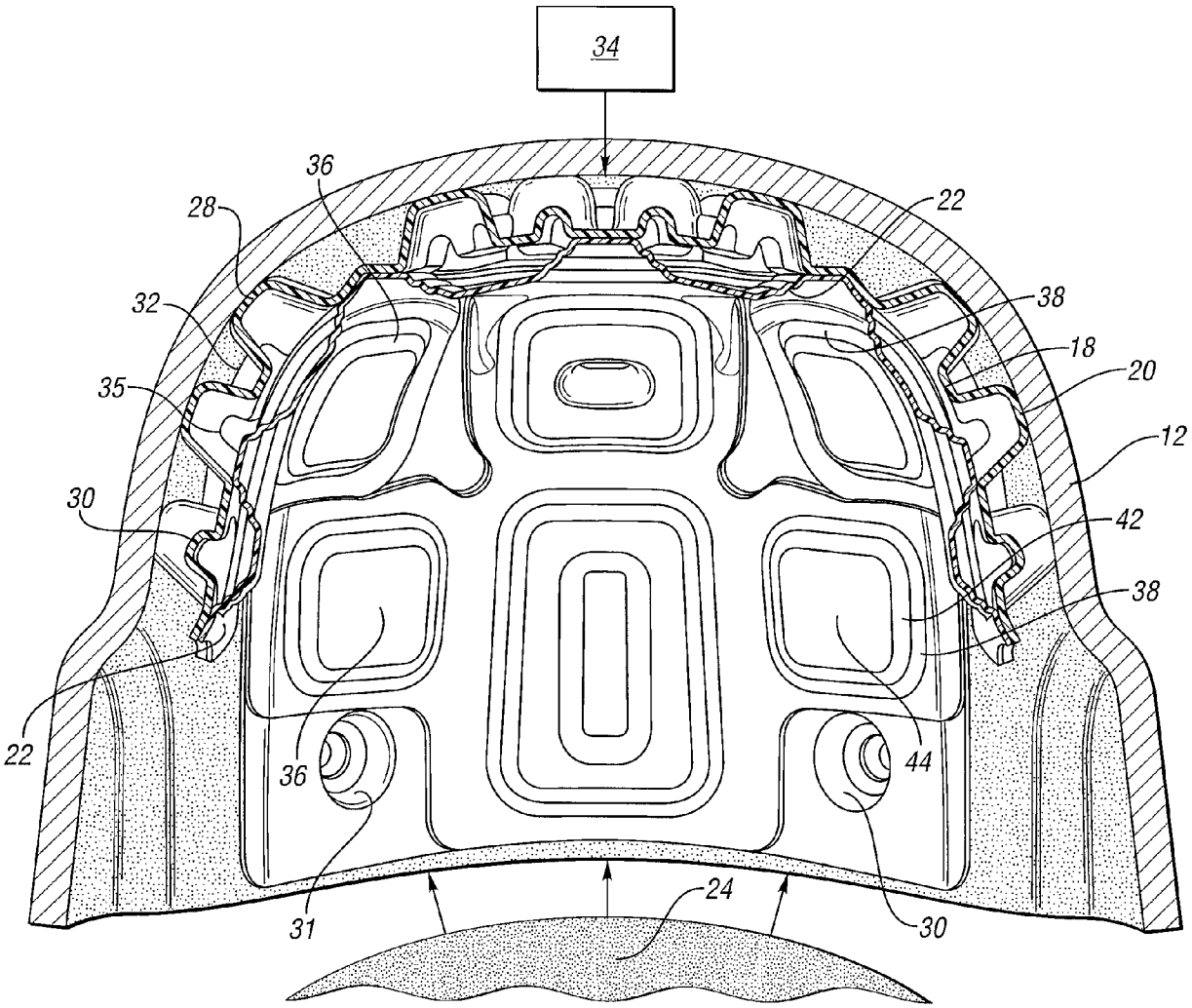
FIG. 13 is a vertical lateral sectional view of the helmet-liner assembly.
Figure 14:
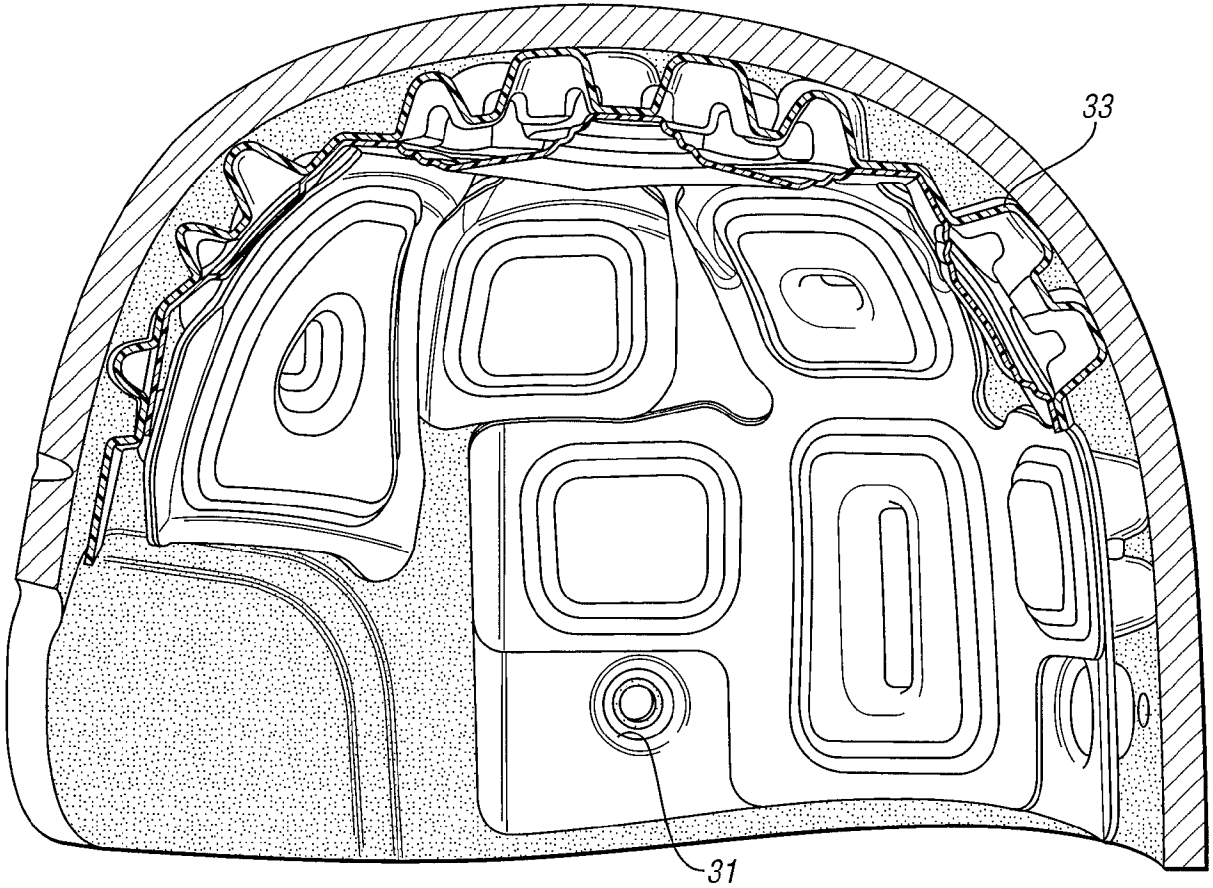
FIG. 14 is another vertical longitudinal perspective view of an embodiment of the invention.

Preferably the upper section 20 has one or more energy absorbing units 28 (FIGS. 12-14). At least some of the units 28 are provided with a rounded wall 30 that in some embodiments is substantially frustoconical with an optional domed cap 32. The wall 30 and the upper basal layer 18 define a perimeter 31 where they intersect. The perimeter 31 has a shape that is selected from the group consisting of a circle, an oval, an ellipse, an oblate oblong, a polygon, a quadrilateral with rounded edges and combinations thereof. Wall 30 has an upper edge 33 that meets the dome 32, the upper edge defining a perimeter where they intersect. That perimeter defines a shape that is selected from the group consisting of a circle, an oval, an ellipse, an oblate oblong, a polygon, a quadrilateral with rounded edges and combinations thereof. Usually the shape of the upper perimeter 33 resembles that of the lower perimeter 31. But their sizes are not necessarily equal, so that an energy absorbing unit may be tapered. Usually the lower perimeter 31 is longer than the corresponding upper perimeter 33.

The units 28 at least partially cushion the blow and revert to or toward an un-deflected configuration by absorbing energy imparted by an object 35 that impacts the outer shell 12. Reversion occurs without substantial loss of structural integrity so that bounce back is essentially non-destructive. If desired, one or more ribs 34 interconnect at least some of the energy absorbing units 28 in one or more modules 16.

Figure 3:
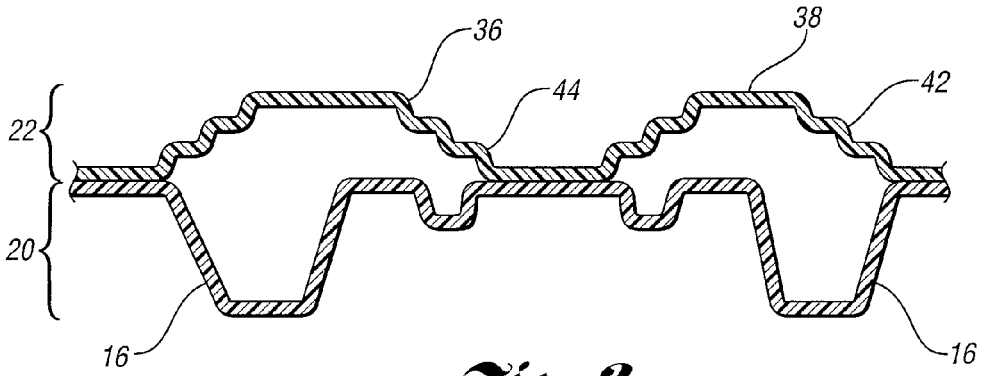
FIG. 3 is a vertical section of a typical energy absorbing module.

In some embodiments, the lower section 22 (the comfort or conforming section) has a tiered arrangement of layers 36 (FIG. 3). An outermost layer 38 cooperates with and lies inside a periphery 40 of the lower section 22. One or more intermediate layers 42 extend from and within the outermost layer 38. An innermost layer 44 extends from and within an intermediate layer 42. The layers 38, 42, 44 are relatively compliant and thus provide a comfortable yet firm fit of the helmet upon the wearer. In some embodiments, the lower section 22 contributes to the reaction forces transmitted across the upper section 20 in response to an impact. It will be appreciated that the number of layers in the lower section 22 is not limited to those specifically depicted. If desired, the layers 38, 42, 44 may be imbued with a gradation of stiffness that presents a progressive change in cushioning characteristics across the lower section 22.

The innermost layers 38, 42, 44 may be provided with an aperture 46 (FIG. 4) that reduces weight and allows air within the modules 16 to bleed therefrom. Thus, the recesses created by the bellowed structure 38, 42, 44 depicted in FIG. 3 provide areas where perforations or apertures 46 may be introduced to allow air flow and improve the convective cooling of the mass to be protected, such as the head. Similarly, the EA (upper) layer 20 may also be perforated or vented to maximize air flow within the shell. Supplemental air flow may also be created between the two layers 16, 22 by employing additional ribbing or channels and provide drainage locations for cleaning purposes. These additional air flow channels are also anticipated to reduce the blast pressures the wearer's head would experience in a blast pressure wave and/or an impacting event.

One aspect of the invention thus includes a helmet 10 and a helmet liner system 12 that, when engineered for a given set of impact conditions, will provide a mass optimized helmet liner 12 with rebound characteristics, superior impact protection, fit, comfort, breathability, and durability at a reasonable cost.

By modifying the shape and orientation of energy absorbing (EA) modules, the resistance of the energy absorber 14 can be tuned to optimize performance around the entire helmet shell 12. The global stiffness of the absorber 14 can also be tuned by running thinner or thicker sheet off a thermoforming tool to soften or stiffen the absorber respectively. Additionally, unlike foam, the EA layer is not solid and has superior cooling characteristics.

In one embodiment (FIGS. 12-14), the lower section 22 of layers 36 of comfort material is attached to the upper section 20 by conventional joining processes. The EA 20 and comfort 22 layers are attached together using traditional plastic joining technologies such as welding and adhesives. But the lower section 22 may or may not be attached to the upper section 20.

In a preferred embodiment, the comfort layer 22 is manufactured from the same material as the EA (upper) layer 20. While several resin candidates have been identified, thermoplastic urethanes (TPU's) have proven to be the most resilient and chemically resistant. There are various grades and manufacturers of TPU. Lubrizol's Estane ETE55DT3 is a desirable material based on resiliency and energy absorbed per unit mass based on performance testing conducted to date. The thickness of the comfort layer 22 is preferably less than or equal to the thickness of the EA layer 20. In one embodiment, as mentioned earlier, the comfort layer 22 has bellowed or tiered structures 36 (like an inverted wedding cake) facing in one or more directions. These structures 36 act like an accordion with bellows (but preferably non-pneumatically) or flex in response to an applied load. If desired, the liner system 10 could be manufactured by twin sheet thermoforming.

Anticipated uses for the disclosed this technology include but are not limited to helmets for soldiers, athletes, workers and the like, plus automotive applications for protecting a vehicle occupant or a pedestrian from injury involving a collision. It is also anticipated that this technology could be applied anywhere that some level of comfort is required in an energy absorbing environment including all types of padding, flooring, cushions, walls, and protective equipment in general. Optionally, the comfort layer 22 could be at least partially inflated primarily for fit.

Figure 2:
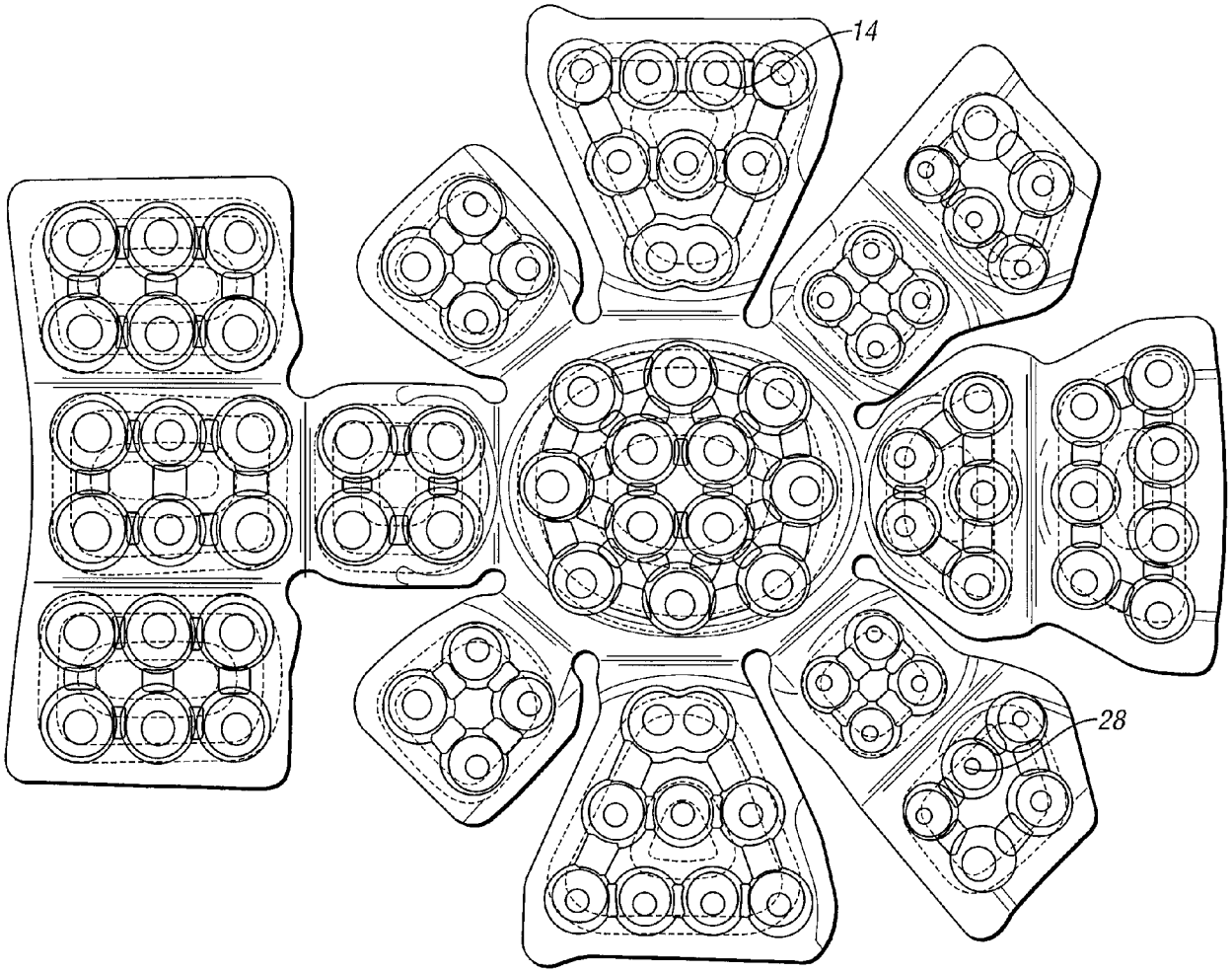
FIG. 2 is a bottom plan view of a bottom (cushioned) section of liner that is flattened before installation, for example, in a helmet.

FIG. 1 is a perspective view of one illustrative embodiment of the invention—an energy absorbing liner 14 for an advanced combat helmet 12. In FIG. 2, the darkened portions represent areas where tiered layers 36, or inverted wedding cake-like structures, bellows, or undulations are engineered for flexibility and comfort. In this embodiment, the darkened areas represent surfaces that would contact the wearer's head. Optionally, a supplemental layer of comfort padding or material may be added to these areas if the fit needs to be customized or the wearer determines that the plastic contact surface is not as comfortable as desired.

In most embodiments, the liner system 14 includes a plurality of interconnected modules 16. FIG. 3 is a section through a typical energy absorbing module 16. These modules 16 may have zero to multiple undulations (to be described) based upon the performance and comfort characteristics desired in a given liner system 14 or module 16.

Figure 5:
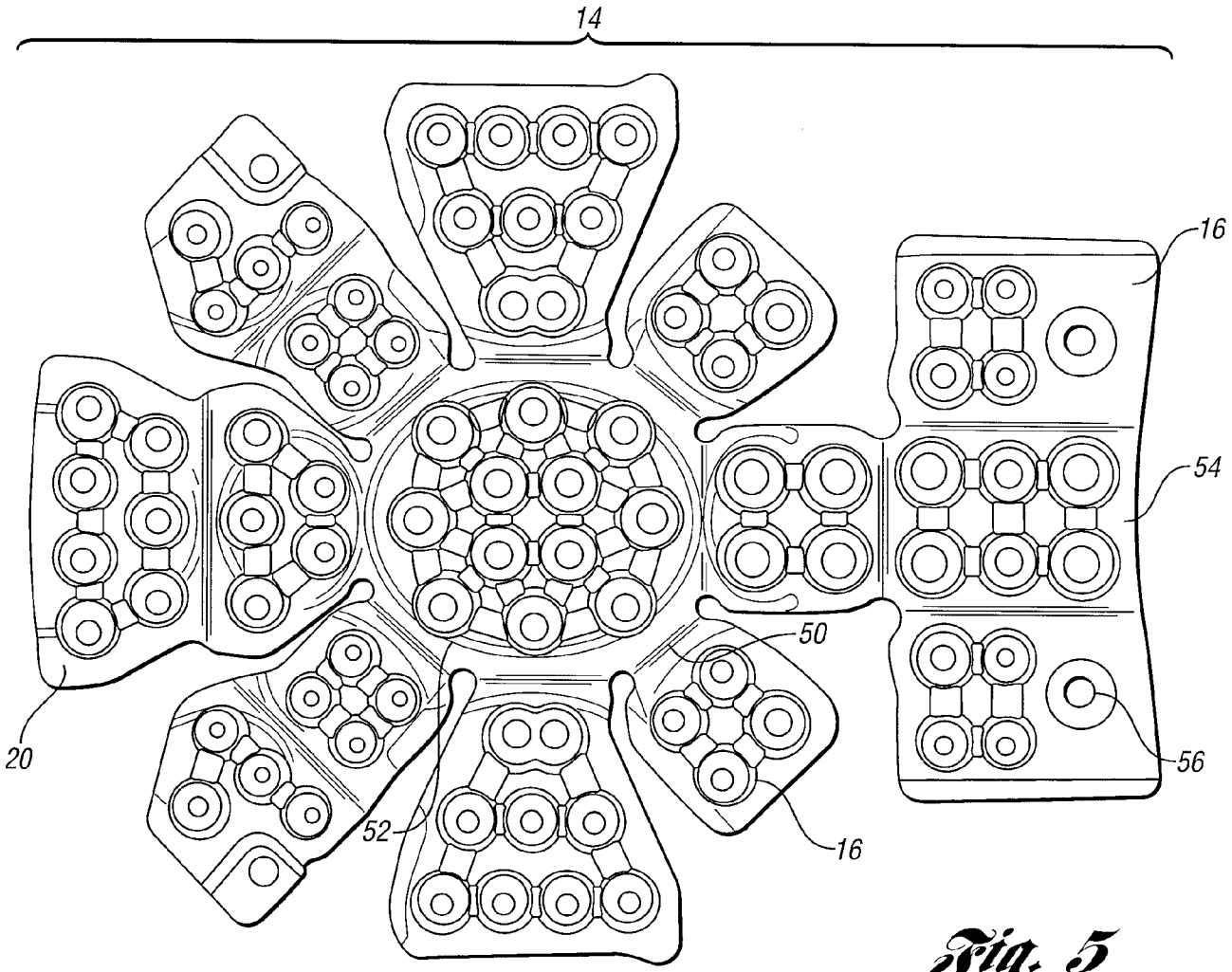
FIG. 5 illustrates a preferred embodiment of an energy absorbing upper section of the liner system, which in the embodiment shown is a one-piece construction of interconnected modules.

Continuing with the primary reference to FIG. 5, a living hinge 50 joins at least some adjacent modules 16 in the upper section 20 of the energy absorbing layer 14. A dome module 52 lies atop the crown of the head of a wearer. At least one satellite module grouping 54 connects with and extends from the dome module 52. At least one of the satellite module grouping 54 comprises one or more modules 16 that are adjoined to each other and to the dome module 52.

Figure 4:
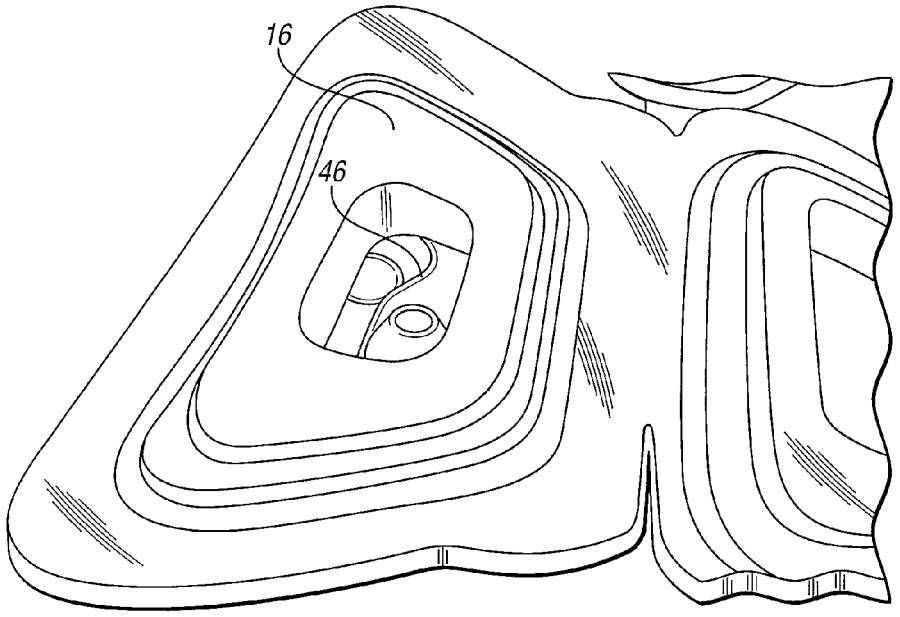
FIG. 4 illustrates one enlarged example of a pair of clusters in a lower section of energy absorbing liner that are interconnected.

FIG. 4 illustrates one enlarged example in which adjacent energy absorbing modules 16 are interconnected.

Traditionally, hook and loop materials of adhesive have been utilized to attach the helmet liner 14 to the helmet shell 12. Also anticipated is the use of other means for attaching such as rivets, coined snaps, add-on fasteners, tape, Velcro® and glue to affix the liner to the shell.

Shown as an example in FIG. 5 is the energy absorbing portion 16 of an advanced combat helmet liner. A preferred embodiment of the EA portion depicted in FIG. 5 is a one piece construction of interconnected modules 16. Fewer attachments and components are necessary to adhere the helmet liner 14 to the helmet shell 12 partially because the modules 16 tend to afford mutual support and assure predictable placement in relation to the helmet 10. Attachment holes 56 can also be provided in one or more sections 20, 22 of the assembly and offer an additional way to adhere the liner 14 to the helmet shell 12.

Helmet systems are designed to absorb and mitigate some of the blunt forces or blast energy from an event. Initial testing of one embodiment indicates that superior impact performance can be obtained when compared to the prior art. This enables a helmet system to be realized that is safer than those which preceded it.

The impact performance of the disclosed system may be tuned or optimized according to the intended use—for example to the skill level of the athlete for recreational sporting helmets. Youth sporting equipment may be less stiff (e.g., formed from a thinner gage of material) and tuned to the speed and mass of the athlete. Professional athletes may require a stiffer absorber due to their increased mass, speed, and aptitude.

Furthermore, the preferred embodiment of the liner system is a one piece construction. This design requires fewer components to assemble. This attribute reduces the assembly labor, cost, complexity, and number of purchased components.

Additionally, the assembly is often lighter in weight and more comfortable than those found in the prior art. The materials of construction are also more resilient to repeat impacts when compared to the prior art.

In another aspect of the invention, the energy absorbing layer 14 includes an upper section 20 with an upper basal portion 18 and a plurality of energy absorbing units 16, many of which are frustoconical extending from the upper basal portion 18. Each energy absorbing unit 16 has a side wall 30 that is oriented so that upon receiving the forces of impact ("incident forces"), the side wall 30 offers some resistance, deflects and reverts (springs back) to or towards a compression set point or to or towards the un-deflected pre-impact initial configuration while exerting reactionary forces to oppose the incident forces. This phenomenon effectively cushions the blow by arresting the transmission of incident forces towards the mass or object to be protected (e.g., an anatomical member, a piece of sheet metal, an engine block, or the head of a passenger or player).

The side wall(s) 30 while deflecting (e.g., by columnar buckling) absorb energy when impacted. Each energy absorbing unit has an end wall or domed cap 32—which may be a "top" or "bottom" end, depending on the orientation of the energy absorbing layer 14 when installed—and a side wall 30 that reverts at least partially towards an un-deflected configuration within a time (T) after impact, thereby absorbing energy non-destructively after the hit.

In some cases, the energy absorbing units 14 revert to or toward an un-deflected or compression-set configuration after a first impact. In other cases, they revert to the compression-set configuration after multiple impacts.

To absorb impact forces, the side wall 30 bends in response to impact and springs back to an un-deflected configuration in further response to impacting forces. In some cases opposing side walls 30 in an energy absorbing unit 28 bend at least partially convexly after impact. In other cases, opposing side walls 30 bend at least partially concavely after impact. Sometimes, opposing side walls 30 bend at least partially concavely and convexly after impact in an accordion-like fashion.

If present, the domed end wall 32 is supported by an upper periphery 33 of the side wall 30 and deflects inwardly, thereby itself absorbing a portion of the energy dissipated upon impact and at least partially springing back to an initial configuration.

Aided by these structures, the disclosed energy absorber 14 can be re-used after single or multiple impacts. For example the hockey or football player need not change his helmet after every blow. This is because the side walls revert toward an un-deflected configuration within a time (T) after the associated crush lobe is impacted. Usually $0<T<$ about 90 seconds. Most of the recovery occurs quite soon after impact. The remainder of the recovery occurs relatively late in the time period of recovery, by analogy to a "creep" phenomenon.

Additional air flow through orifices or channels provided in the helmet liner 14 improves head cooling and provides some level of increased protection from blast events when compared to the prior art.

Further, the liner system 14 is quite easy to clean and has improved chemical resistance compared to many products found in the prior art.

Figure 6:
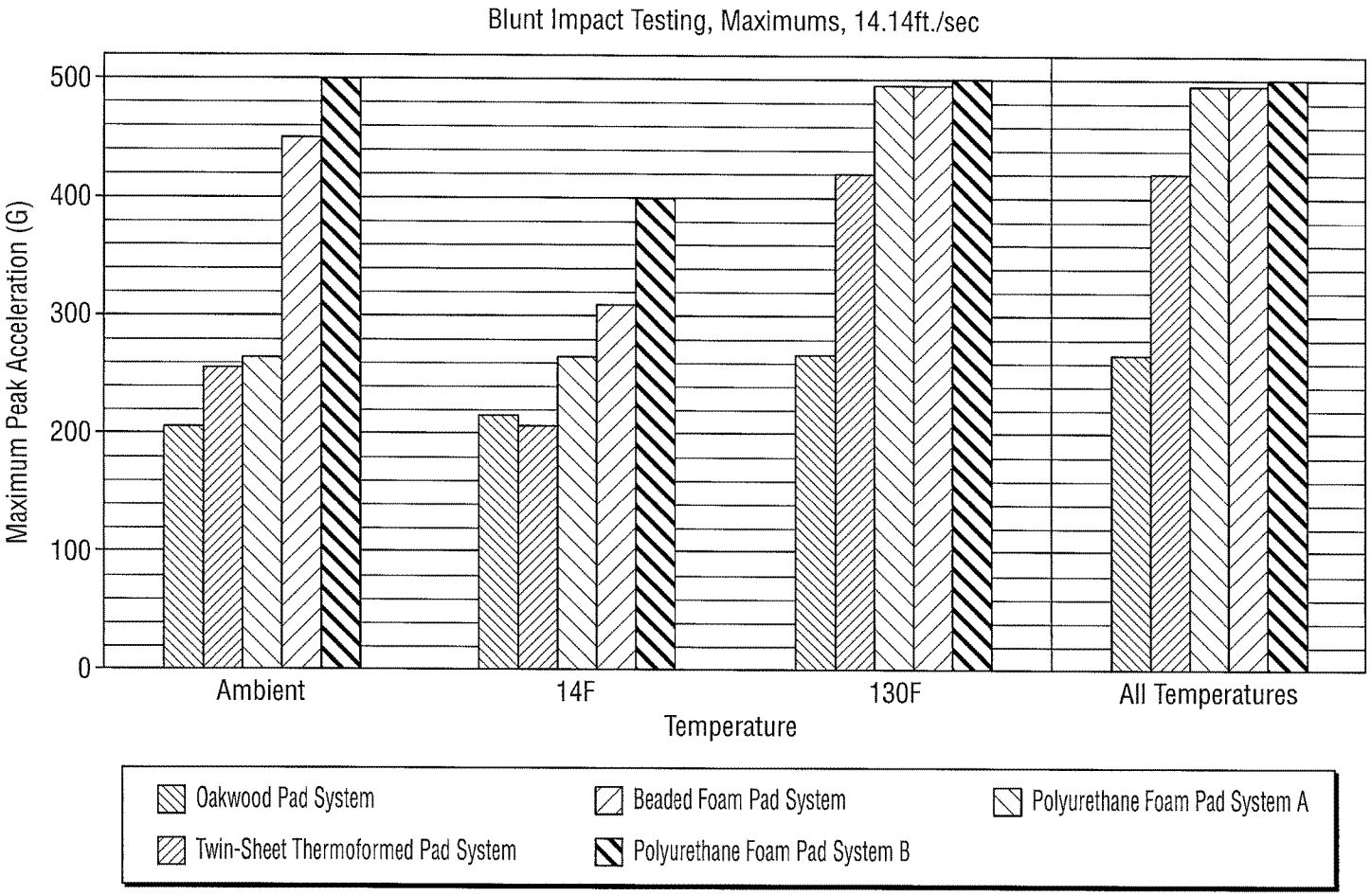
FIG. 6 is a graph comparing the blunt impact performance of one example of the inventive recoverable energy absorber compared to the prior art as a function of temperature.
Figure 7:
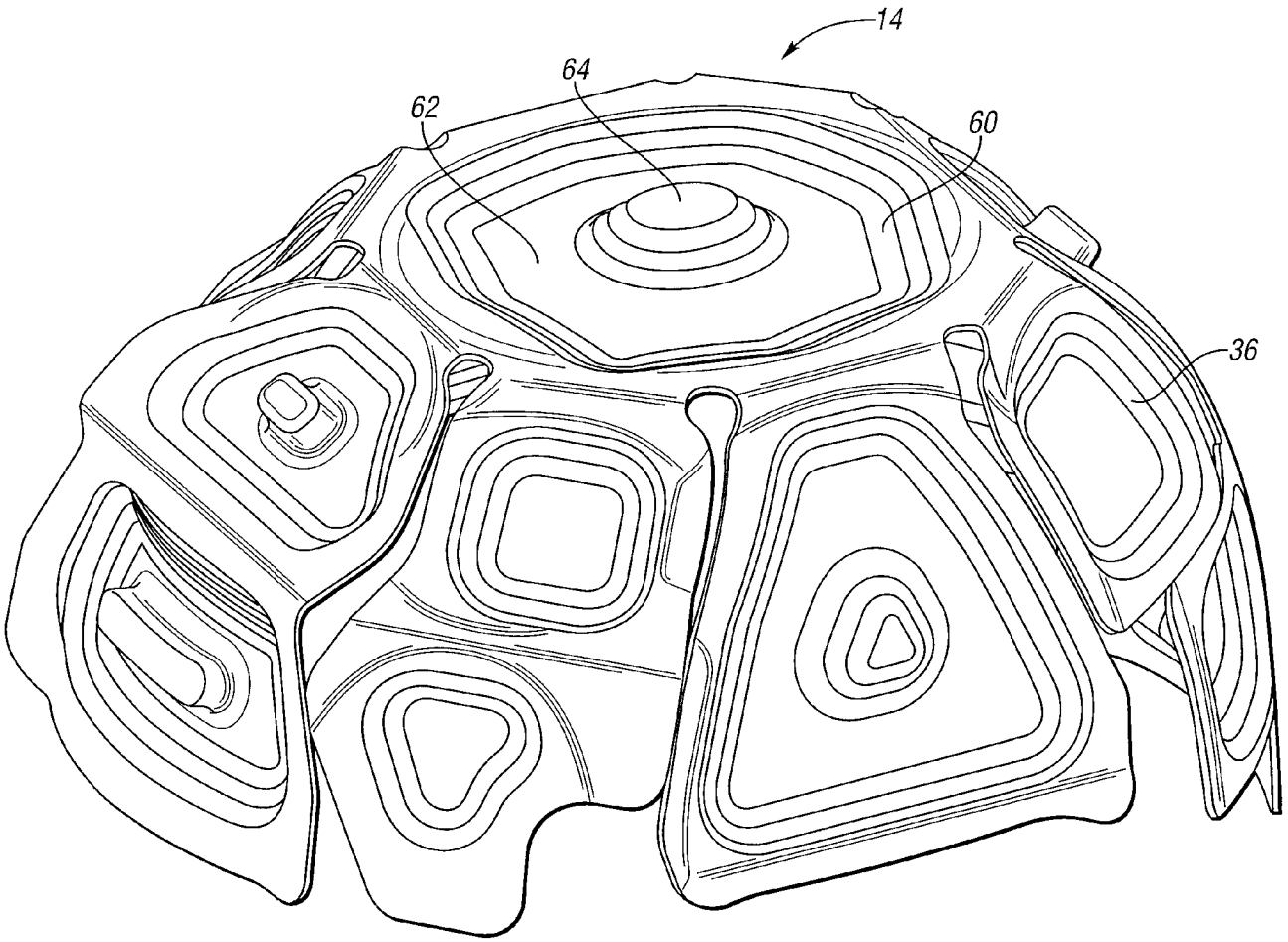
FIG. 7 is a quartering perspective view of a liner system with the helmet not shown, in which a portion that faces the forehead of the wearer appearing on the lower left side.
Figure 8:
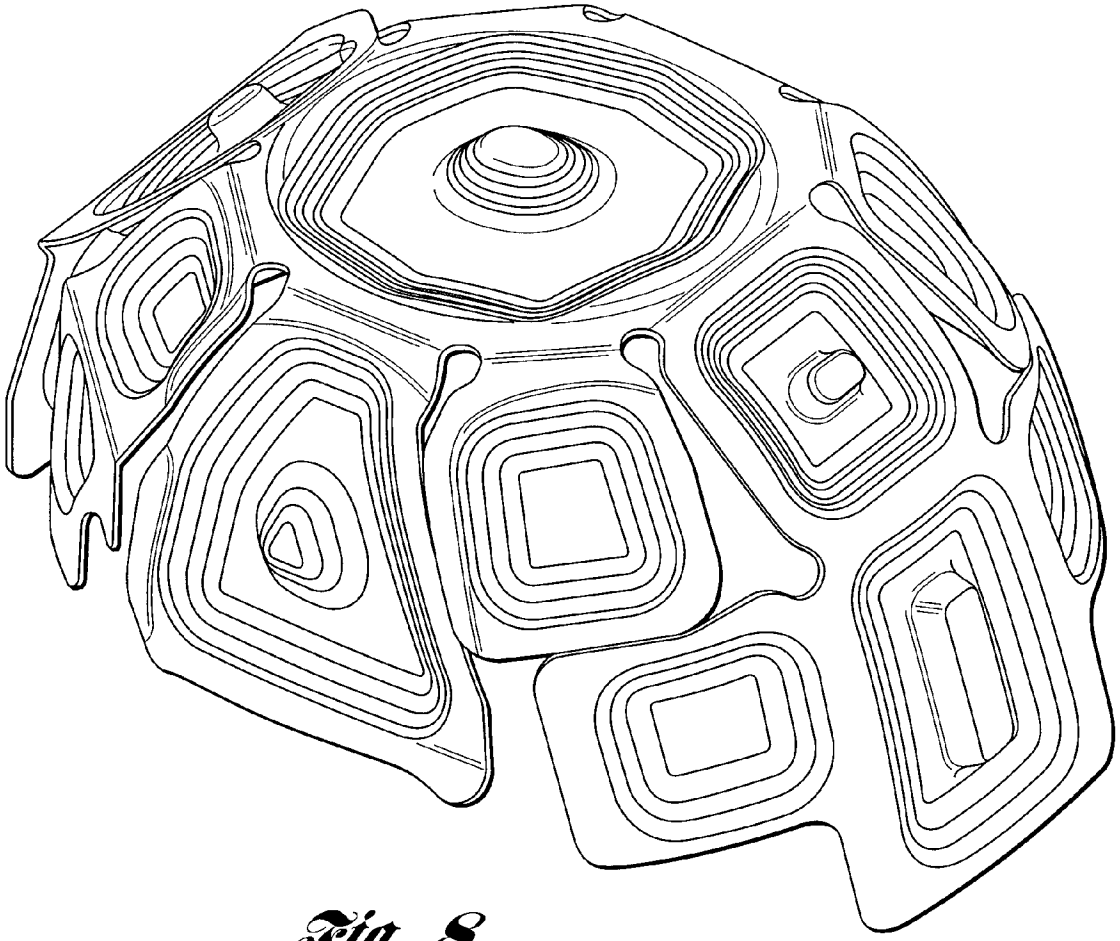
FIG. 8 resembles the view of FIG. 7, taken from a different vantage point, in which the portion which interfaces with the back of the wearer's head appears in the lower right side.
Figure 9:
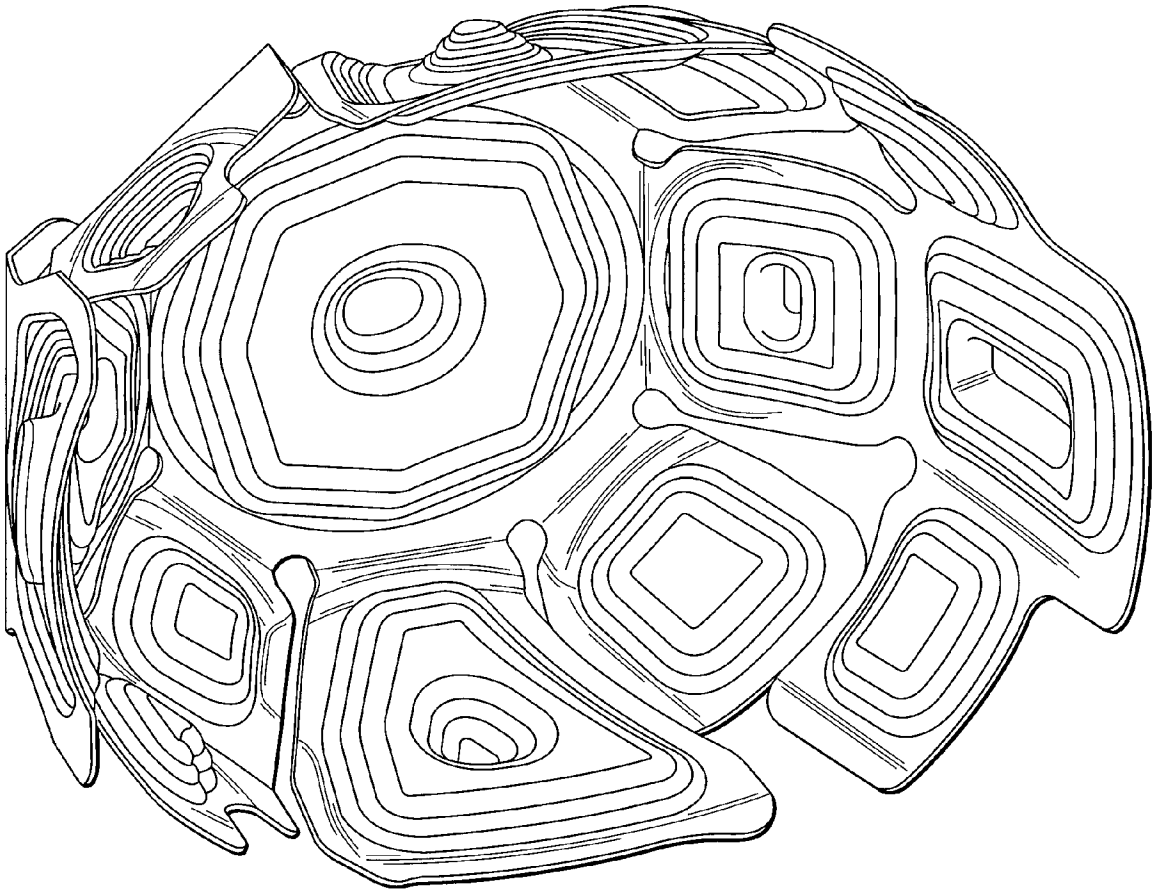
FIG. 9 illustrates an inside of the liner system when viewed upwardly—the rear head portion is on the left, and the neck portion lies on the right.
Figure 10:
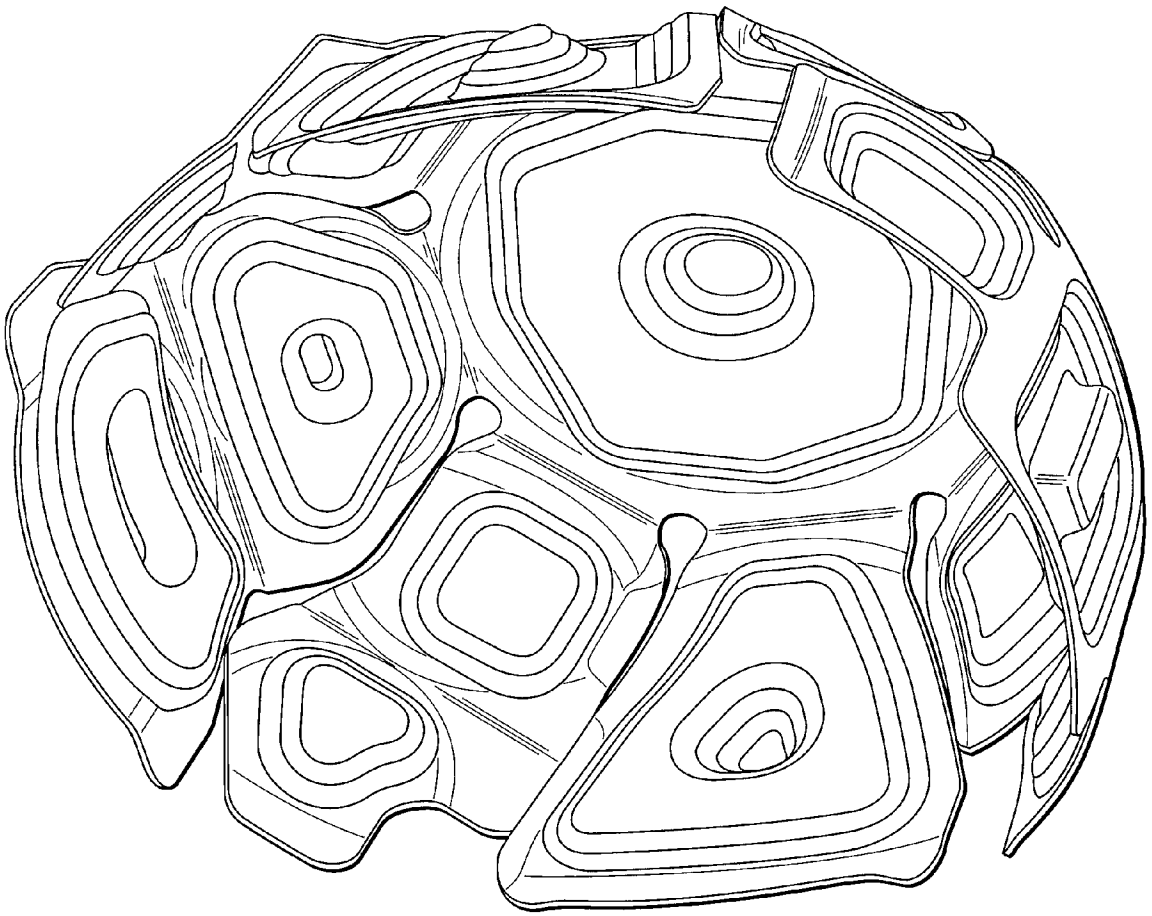
FIG. 10 resembles the view of FIG. 9 but from a shifted vantage point.

It is thought that the overall system performance (and cost) is anticipated to be near the best in the industry based on market analysis completed to date. Shown in FIG. 6 is a graph comparing the blunt impact performance of one example of the inventive recoverable energy absorber 14 compared to the prior art as a function of temperature. The graph of FIG. 6 indicates that over almost all tested temperatures, the maximum forces experienced by the head of a wearer provided with an inventive pad system 14 is substantially less than experienced using other technologies when exposed to comparable impacting forces. Lower peak accelerations provide a better chance of avoiding serious injury or death.

It is also anticipated that in some instances, it may be desirable to pressurize one or more modules 16 to customize the fit of the absorber 14 to the wearer or topography of the mass to be protected.

Comfort layers of cloth or material may also be introduced between the absorber and the head to improve comfort such as a "Doo Rag" (a piece of cloth used to cover the head).

Further, the Applicant's pending soft top technology may also be employed to minimize the potential for unwanted noise (BSR) from the assembly. See e.g., U.S. Ser. Nos. 12/729,480 and 13/155,612 which are incorporated herein by reference.

FIGS. 7-14 illustrate various aspects of the lower section 22 of the liner system 14. The lower section 22 of the energy absorbing layer 14 as mentioned earlier, has a tiered arrangement of layers 36. The layers 36 include an outer stepped region 60, a floor 62 upon which the outer stepped region 60 terminates and in some embodiments an inner region 64 that extends from the floor 62. In some embodiments, the inner region 64 is also provided with a tiered arrangement of layers.

Figure 11:
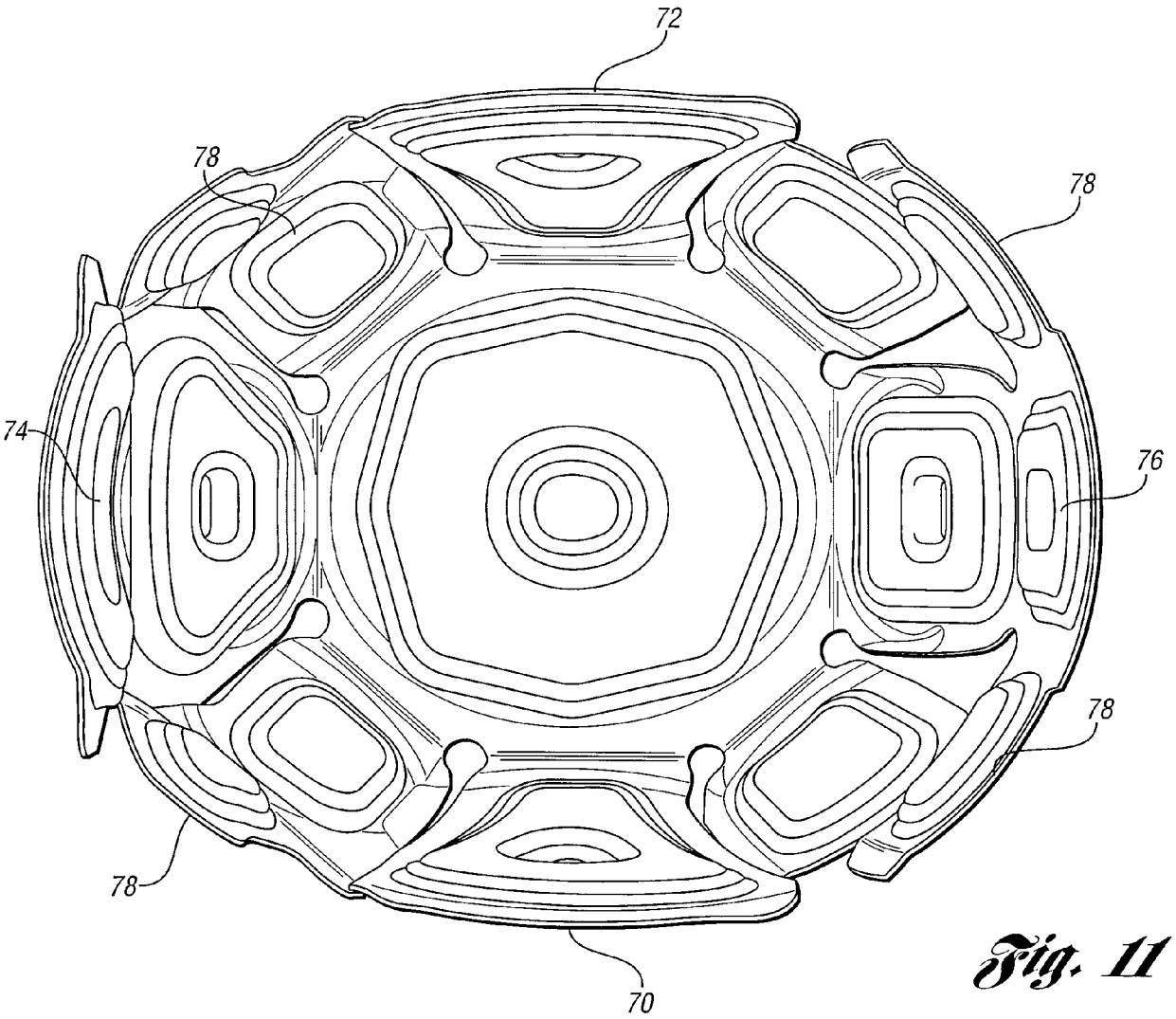
FIG. 11 resembles the view of FIG. 10.

Turning now to FIG. 11, it will be appreciated that some of the comfort clusters include one or more side clusters 70, 72 that at least partially cover the ears of the wearer or another mass to be protected. One or more back clusters 74 at least partially cover the back of a wearer's head or other mass. One or more front clusters 76 at least partially cover a wearer's forehead or other mass. If desired, one or more interstitial clusters 78 may lie between the side, front and back clusters.

In some applications, it may be desirable to orient the upper section 20 so that the energy absorbing units 28 face downwardly and the upper basal layer is juxtaposed with the outer shell 12 of the helmet. In such configurations, the lower basal portion 19 of the lower section 22 is adjoined to the upper basal portion 18 of the upper section 20.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A helmet with an outer shell; and an energy absorbing layer positioned inside the outer shell, the layer having one or more energy absorbing modules, at least some of the modules having the characteristic of reversion after impact to or towards an un-deflected configuration, one or more of the energy absorbing modules having an upper energy absorbing section having an upper basal layer one or more energy absorbing units that extend from the upper basal layer, at least some of the one or more energy absorbing units being provided with a flexible wall that extends from the upper basal layer, the one or more energy absorbing units at least partially absorbing energy generated by an impacting object by the flexible wall bending inwardly or outwardly without rupture; and a lower compliant section having a lower basal layer that interfaces with the upper basal layer of the upper energy absorbing section a tiered arrangement of layers extending from the lower basal layer, the arrangement including a radially outermost layer that cooperates with and lies inside a perimeter of the lower basal layer, one or more radially intermediate layers extending from and within the outermost layer and a radially innermost layer that extends from and within an intermediate layer, the layers in the tiered arrangement being relatively compliant and cooperating at least partially in a telescoping manner in response to a force transmitted across the lower compliant section, thereby providing a comfortable yet firm fit of the energy absorbing modules to a mass to be protected from at least some of the impacting force.

2. The liner system of claim 1, further including a living hinge that joins at least some adjacent modules in the energy absorbing layer.

3. The liner system of claim 1, wherein one of the energy absorbing modules comprises a dome module that lies atop the head of a wearer.

4. The liner system of claim 3, further including at least one satellite module grouping that connects with and extends from the dome module.

5. The liner system of claim 1, further including attachment holes defined in the upper base layer, the lower base layer or in the upper and lower base layers for attaching the liner system to the outer shell that meets an impacting object.

6. The liner system of claim 1, wherein the tiered arrangement of layers in the lower section includes comfort clusters, at least some of the clusters each having:

an outer stepped region;

a floor upon which the outer stepped region terminates; and an inner region that extends from the floor.

7. The helmet of claim 1, further including one or more supplemental layers of comfort padding between the lower section and the head of the wearer.

8. The liner system of claim 1, wherein the upper section is inverted so that the upper basal layer is oriented towards the outer shell and the one or more energy absorbing units extend toward the lower section.

9. The liner system of claim 1, wherein the liner system is attached to the outer shell by means for attaching, including but not limited to, rivets, coined snaps, add-on fasteners, tape, Velcro®, hook and loop materials, adhesive, and glue.

* * * * *